United States Patent [19]

Chervenak et al.

[11] 4,054,504

[45] Oct. 18, 1977

[54] CATALYTIC HYDROGENATION OF BLENDED COAL AND RESIDUAL OIL FEEDS

[75] Inventors: Michael C. Chervenak, Pennington; Edwin S. Johanson, Princeton, both of N.J.

[73] Assignee: Hydrocarbon Research, Inc., Morristown, N.J.

[21] Appl. No.: 618,911

[22] Filed: Oct. 2, 1975

[51] Int. Cl.[2] ..... C10G 1/08

[52] U.S. Cl. ..... 208/10

[58] Field of Search ..... 208/10

[56] References Cited

U.S. PATENT DOCUMENTS

| | | | |
|---|---|---|---|
| 2,987,465 | 6/1961 | Johanson | 208/10 |
| 3,519,553 | 7/1970 | Johanson et al. | 208/10 |
| 3,540,995 | 11/1970 | Wolk et al. | 208/10 |
| 3,617,474 | 11/1971 | Stotler et al. | 208/10 |
| 3,642,608 | 2/1972 | Roach et al. | 208/8 |
| 3,849,287 | 11/1974 | Gleim et al. | 208/8 |
| 3,867,275 | 2/1975 | Gleim et al. | 208/8 |
| 3,870,621 | 3/1975 | Arnold et al. | 208/8 |

*Primary Examiner*—Delbert E. Gantz
*Assistant Examiner*—James W. Hellwege
*Attorney, Agent, or Firm*—Michael A. Jacobs

[57] ABSTRACT

A process is provided for the simultaneous conversion of coal and residuum oil to predominantly liquid products, employing ebullated bed techniques. A fluid blend of particulate coal admixed with crude oil comprising from about 20 to 100% by weight of residuum oil boiling above about 975° F. is contacted with hydrogen in the presence of an ebullated bed of particulate hydrogenation catalyst to effect conversion of at least about 50% of the residuum oil component and up to about 94% of the m.a.f. coal. In an alternate embodiment the oil feed includes recycled oil from the product liquids.

8 Claims, 2 Drawing Figures

CATALYTIC HYDROGENATION OF BLENDED COAL AND RESIDUAL OIL FEEDS

BACKGROUND OF THE INVENTION

Numerous methods have been proposed in the prior art for effecting the conversion of coal into liquid fuel. Present commercial conversion methods conventionally comprise subjecting a coal-oil slurry to catalytic hydrogenation at elevated temperatures and pressures to produce a coal-derived synthetic crude oil distillate. Typically, these methods include an ebullated bed technique wherein a stream of the coal-oil slurry admixed with gaseous hydrogen is passed upwardly through an ebullated bed reactor containing a mass of particulate hydrogen catalyst, thereby ebullating the catalyst particles and promoting hydrogenation of the coal.

Exemplary of such prior art technques are those described in U.S. Pat. Nos. 3,791,957 to Wolk; 3,607,719 to Johnson et al; 3,594,305 to Kirk; 3,586,621 to Pitchford et al; 3,755,137 to Schuman; 3,519,555 to Keith et al; 3,338,820 to Wolk et al; 3,540,995 to Wolk et al; and 3,679,573 to Johnson.

Such techniques, while generally effective in converting coal into the desired liquid product, have characteristically been limited to conversion of the coal. While the desirability of effecting simultaneous conversion of both coal and oil feed components in these ebullated bed procedures has been recognized, for example, to increase the conversion efficiency of the hydrogenation process and to avoid the present necessity for reprocessing the slurry oil stream through the reactor equipment train, effective simultaneous conversion of the coal and oil feedstock components has been generally considered impractical, owing in part to the different reaction conditions thought necessary for the conversion of the separate components, and to the expected incompatibility of the product liquids, particularly those comprising full range distillates boiling up to about 1000° F.

While other techniques have been employed for the conversion of oil and coal, such as the fluidized bed techniques described in U.S. Pat. Nos. 3,870,621 (Arnold et al) and 3,652,446 (Dingler), these techniques have not heretofore generally provided for the effective simultaneous conversion of coal and oil blends.

SUMMARY OF THE INVENTION

The invention broadly comprises a process for the simultaneous conversion of the coal and residuum oil components of a fluid coal-oil blend wherein at least about 50% of the residuum oil component is converted to an oil distillate boiling below about 975° F. and from about 80 up to about 94% of the m.a.f. coal component is converted to liquid products. In the preferred embodiment of the invention, a fluid feedstock blend comprising particulate coal and crude oil is contacted with hydrogen in the presence of an ebullated bed of commercial hydrogenation catalyst particles, in accordance with conventional ebullated bed apparatus and techniques such as described, for example, in U.S. Pat. No. Re. 25,770.

Finely divided coal, which may suitably comprise bituminous, sub-bituminous or lignite-type coal is admixed with sufficient crude oil comprising from about 20 up to 100% by weight of residuum oil boiling above about 975° F. to provide a fluid coal/oil blend. Conversion of the coal and oil components of this blend is effected by feeding the blend through an ebullated bed reactor where it is contacted with hydrogen in the presence of a bed of commercial hydrogenation catalyst particles. Preferably, the crude oil feed has a metal content of less than about 300 ppm, as metal contents in excess of this amount will necessitate uneconomically high catalyst replacement rates in the reactor to maintain desirable conversion rates. The space velocity of the coal/oil blend over the catalyst particles is maintained at a rate of at least from about 20 to about 150 pounds of coal plus oil per hour per cubic foot of reactor. While some conversion of both the coal and oil components may occur at space velocities of the coal-/oil blend above this specified range, it has been found that, in order to achieve the unexpected improvement in the oil and coal conversion rates obtainable by the process of this invention, space velocities below the critical rate of about 150, and preferably within the range of from about 40 to about 100 pounds of coal plus oil per hour per cubic foot of reactor volume, must be maintained.

The reaction zone is maintained at a hydrogen partial pressure of from about 1000 to abut 4000 p.s.i.g., and preferably from about 1500 to about 3000 p.s.i.g.; temperature within the reaction zone is maintained at from about 750° to about 900° F., and preferably from about 800° to about 875° F. The percentage of unconverted coal and ash solids in the reaction zone is controlled within a desired range of 10–25 wt. percent by recycling to the reaction zone a portion of separator bottoms liquid streams from which solids may have been partially removed. Product liquid effluent is removed from the reactor in a conventional manner, with subsequent fractionation and processing as desired.

In general, the proportions of crude oil to coal in the feedstock blend are determined by product objectives and feed availability. Broadly, at least sufficient oil is admixed with the particulate coal to provide a sufficiently fluid blend to permit pumping of the blend through the conversion system and to permit adequate fluidization of the catalyst bed. Typically, oil to coal weight ratios of from about 1.5 to about 10 lbs. of oil per lb. of coal are employed; preferably, from about 1.7 to about 3 lbs. of oil per lb. of coal are employed to maximize efficiency of conversion of both the coal and oil blend components.

In an alternate embodiment of this invention, selected heavy liquid products are recycled for blending with the finely divided coal. In this embodiment, sufficient processed oil preferably comprising residuum-containing oil, is recycled to the coal blending step to provide a total oil to coal ratio in the feedstock blend of at least about 1.5 lbs. of oil per pound of coal, and preferably a ratio of from about 1.7 to 3 lbs. of total oil per pound of coal. In practice, this embodiment of the invention is typically employed when, for example, insufficient crude oil feed is available to provide a weight ratio of crude oil to coal in the feedstock blend of at least about 1.5, which represents a total feed blend composition of about 40% coal and about 60% oil by weight. In this event, the balance of the oil requirement for bringing the total oil to coal ratio to the operable level of at least about 1.5 lbs. of oil per pound of coal is met by recycling some processed oil to the coal/oil blending step.

DETAILED DESCRIPTION OF THE DRAWING

Figure 1:
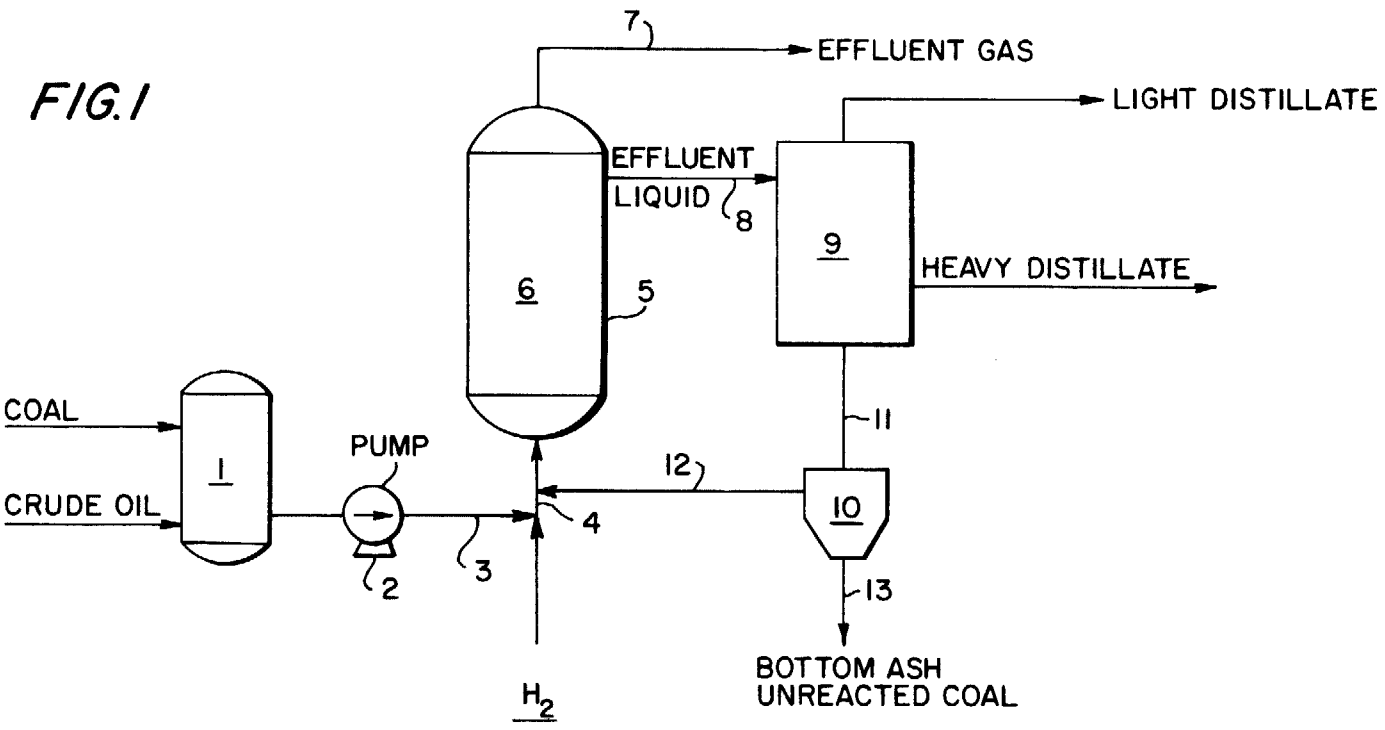
FIG. 1 is a schematic diagram of the preferred embodiment of the process of this invention, illustrating the principal steps of the process.

With particular reference to FIG. 1, coal which has been ground to a particle size of less than about 50 mesh (U.S. Seive Series) is passed to a slurry mixing zone 1 where it is blended with crude oil comprising at least about 20% of residuum oil boiling above about 1000° F. in a weight ratio of crude oil to coal at least sufficient to provide a pumpable slurry, and preferably in a weight ratio of about 1.7:1 to about 3:1.

The coal-oil blend in the slurry mixing zone 1 is pressurized by a pump 2 which pumps the blend through intercommunicating conduits 3 and 4 to an ebullated bed reactor 5 containing a particulate commercial hydrogenation catalyst 6. The conduit 4 also serves to conduct gaseous hydrogen from a hydrogen source $H_2$ to the reactor 5. Preferably, the coal-oil blend has an upward velocity of from about 0.05 to about 0.15 feet per second within the reactor 5; hydrogen is passed through the conduit 4 into the reactor 5 concurrently with the coal-oil blend at an upward velocity of from about 0.05 to about 0.3 feet per second to provide a combined upward velocity of blend and hydrogen within the reactor 5 of from about 0.1 to about 0.4 feet per second. The catalyst 6, which may suitably comprise nickel molybdate or cobalt molybdate on alumina or similar material, is kept in constant random motion during reaction by the upward velocity of the hydrogen and coal-oil blend.

The coal-oil blend is fed through the reactor 5 over the catalyst 6 at a space velocity of from about 20 to 150 pounds of coal plus oil, and preferably from about 40 to 100 pounds of coal plus oil, per hour per cubic foot of reactor volume.

In the reactor 5, simultaneous conversion of the coal and residuum oil occurs with consumption of hydrogen. Product gaseous effluent leaves the reactor 5 through a conduit 7, and is subsequently utilized, for example, in hydrogen recovery, hydrogen manufacture, or petroleum refining. Liquid effluent leaves the reactor 5 through a conduit 8 communicating with a fractionation system 9, where the liquid is fractionated into product streams comprising light and middle distillates, heavy gas and oil distillates, and residuum boiling range oils containing unconverted coal and ash. Typically, the weight ratio of gaseous effluent to liquid effluent produced by the process of the invention is about 1:15. Bottoms from the fractionator 9 are conducted to a liquid-solids separator 10 via a conduit 11, and a portion of the substantially solids-free liquid bottoms are recycled from the separator 10 to the reactor 5 via intercommunicating conduits 12 and 4 to control the percentage of unconverted coal and ash solids in the reaction zone within a desired range, typically from about 10 to about 25 wt. percent. The remainder of the materials in the separator 10 are withdrawn through a conduit 13 for subsequent use, for example in coking, as fuel, or as raw material for hydrogen manufacture.

Figure 2:
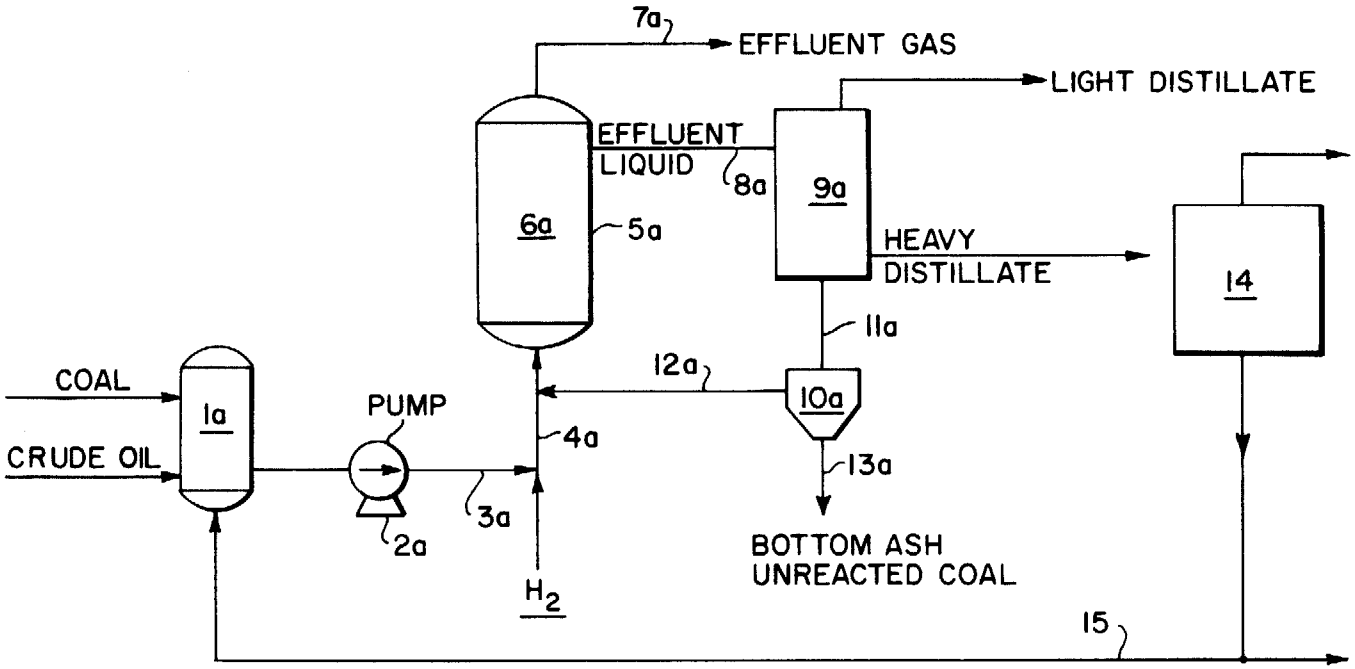
FIG. 2 is an alternate embodiment of the process of this invention illustrating the principal steps of this embodiment of the process.

With particular reference to FIG. 2, an alternate embodiment is therein illustrated, including a slurry mixing zone 1*a*, a pump 2*a*, an ebullated bed reactor 5*a* with catalyst 6*a*, a fractionation system 9*a* and a liquid-solids separator 10*a*. As described above, coal and crude oil are blended in the mixing zone 1*a* and pressurized and pumped by pump 2*a* to the reactor 5*a* via conduits 3*a* and 4*a*, while hydrogen is passed from a source $H_2$ to the reactor 5*a* via the conduit 4*a*. Effluent gas from the reactor 5*a* is removed via a conduit 7*a*, while effluent liquid is conducted to the fractionation system 9*a* via a conduit 8*a* for fractionation into light and heavy distillates. Bottoms from the fractionator 9*a* are moved to the liquid-solids separator 10*a* via conduit 11*a*, with a portion of the substantially solids-free bottoms liquid being recycled to the reactor 5*a* via a conduit 12*a* as required. In this embodiment of the invention, distillate from the fractionator 9*a* is directed to a further distillation zone 14, and a selected portion of the product distillate ffrom the zone 14 is recycled to the slurry mixing zone 1*a* via a conduit 15 to provide slurrying liquid for the coal. The selected oil, which preferably comprises residuum-containing oil, is recycled as required to provide a total oil to coal ratio within the zone 1*a* of at least about 1.5 to 10, and preferably from about 1.7 to 3, pounds of oil per pound of coal.

The following Tables I–IV provide a summary of the feedstock and resultant products obtained in the conversion of a blend of Illinois No. 6 coal and Kuwait vacuum residuum blend according to the process of the present invention.

Run A was carried out on a blend of one weight Illinois No. 6 coal and 2.12 weights of Kuwait vacuum residuum as feed; no recycle oil was employed. The operating conditions of the ebullated bed reactor were 840° F. temperature and 2250 psig. hydrogen partial pressure, those which would be used to obtain 70–75% conversion of the residuum to lighter products. A commercial cobalt-molybdenum hydrogenation catalyst was employed. The yield of distillable oils ($C_4$—975° F) amounted to 66.2% of the dry feed coal plus oil, which compares to an estimated yield of these fractions of 65.5 W% of feed oil when feeding the residuum oil only at the same space rate. The conversion of coal to liquids and gases amounted to 94% of moisture-and ash-free (m.a.f.) coal.

Run B was carried out on a blend of one weight Illinois No. 6 coal and 1.08 weight Kuwait vacuum residuum as feed. In addition to this net feed, a selected portion of the heavy product stream was recycled in a ratio of 1.5 weights recycle product to 1 weight coal to provide a portion of the carrier liquid for the coal. The operating conditions and catalyst were as above-described for the run A. The yield of distillable liquids ($C_4$—975° F) amounted to 59.2 W% of coal plus oil feed, which compares to an estimated yield of these fractions of 65.5 W% of oil feed when feeding the residuum oil only at the same space rate. The conversion of coal to liquids and gases amounted to 93 W% of moisture and ash-free (m.a.f.) coal.

TABLE I

| ANALYSIS OF ILLINOIS NO. 6 COAL | |
|---|---|
| Moisture, W % | 1.60 |
| Ultimate Analysis, W % (Dry Basis) | |
| Carbon | 67.25 |
| Hydrogen | 4.81 |
| Nitrogen | 1.02 |
| Sulfur | 4.85 |
| Ash | 9.93 |
| Oxygen (Difference) | 12.14 |

TABLE II

| ANALYSIS OF KUWAIT VACUUM RESIDUUM | |
|---|---|
| Gravity, ° API | 7.6 |
| Sulfur, W % | 5.59 |
| Carbon, W % | 83.62 |

TABLE II-continued

| ANALYSIS OF KUWAIT VACUUM RESIDUUM | |
|---|---|
| Hydrogen, W % | 10.29 |
| Hydrogen/Carbon Atomic Ratio | 1.47 |
| Nitrogen, W % | 0.33 |
| Vanadium, ppm | 97 |
| Nickel, ppm | 32 |
| Volume Percent at 975° F | 7.3 |
| Weight Percent at 975° F | 6.7 |

TABLE III

| CALCULATED INSPECTIONS OF BLENDED FEED | Run | |
|---|---|---|
| | A | B |
| Weight Percent Coal in Feed Blend | 32.0 | 48.0 |
| Weight Percent Kuwait Vacuum Residuum in Feed Blend | 68.0 | 52.0 |
| Moisture, W % | 0.29 | 0.76 |
| Carbon, W % (Dry Basis) | 78.51 | 75.91 |
| Hydrogen, W % (Dry Basis) | 8.56 | 7.69 |
| Nitrogen, W % (Dry Basis) | 0.55 | 0.66 |
| Sulfur, W % (Dry Basis) | 5.36 | 5.24 |
| Ash, W % (Dry Basis) | 3.16 | 4.72 |
| Oxygen, W % (Dry Basis) (Difference) | 3.86 | 5.78 |
| Weight Percent IBP-975° F in Feed | 4.6 | 3.5 |

TABLE IV

| SUMMARY OF YIELDS | Runs | |
|---|---|---|
| | A | B |
| Weight Percent Coal in Feed Blend | 32.0 | 48.0 |
| Weight Percent Kuwait Vacuum Residuum in Feed Blend | 68.0 | 52.0 |
| Temperature in Reaction Zone | 840° F. | 840° F. |
| $H_2$ Pressure in Reaction Zone (p.s.i.g.) | 2250 | 2250 |
| Feed Space Velocity, lbs. coal + oil/hr./ft.$^3$ | 49.4 | 52.3 |
| Yields, W % Total Dry Feed | | |
| $CO_2$ | 0.10 | 0.17 |
| CO | 0 | 0.06 |
| $C_1$–$C_3$ | 4.04 | 4.78 |
| $C_4$–400° F | 13.44 | 12.65 |
| 400–650° F | 24.50 | 20.57 |
| 650–975° F | 28.27 | 25.99 |
| 975° F+ | 18.12 | 21.0 |
| Unconverted Coal | 1.68 | 2.87 |
| Ash | 3.17 | 4.72 |
| Water | 4.55 | 5.71 |
| $NH_3$ | 0.36 | 0.38 |
| $H_2S$ | 4.62 | 4.05 |
| Total | 102.86 | 102.95 |
| Hydrogen Consumption MSCF/Ton Dry Feed | 10.75 | 11.09 |
| C –400° F - Gravity, ° API | 62.2 | 63.1 |
| Sulfur, W % | 0.03 | 0.07 |
| 400–650° F - Gravity, ° API | 29.6 | 25.7 |
| Sulfur, W % | 0.09 | 0.23 |
| 650–975° F - Gravity, ° API | 15.6 | 11.7 |
| Sulfur, W % | 0.50 | 0.83 |

TABLE IV-continued

| SUMMARY OF YIELDS | Runs | |
|---|---|---|
| | A | B |
| 975° F+ - Gravity, ° API | −0.4 | −3.6 |
| Sulfur, W % | 2.00 | 2.43 |

The above description is intended to exemplify and illustrate the process of the present invention. Modifications and equivalents will be apparent to those skilled in the art, and no limitations are intended thereby, except as defined in the appended claims.

What is claimed is:

1. A continuous process for the hydro conversion of a fluid blend of solid and liquid fossil fuels comprising:

a. premixing a solid particulate stream consisting essentially of finely divided coal with a sufficient amount of a liquid stream consisting essentially of non-volatile hydrocarbon oil comprising a crude oil having at least about 20% by weight residuum oil boiling above about 975° F. to provide a flowable blend;

b. contacting the blend with hydrogen-rich gas at a temperature of from about 750° F. to about 900° F and hydrogen partial pressure of from about 1000 to about 4000 p.s.i.g. in the presence of an ebullated bed of hydrogenation catalyst particles at space velocity between about 20 and 150 pounds of coal plus oil per hour per cubic foot reactor volume to convert the solid and liquid fossil fuels; and c. recovering distillable liquid and gaseous hydrocarbon products.

2. The process of claim 1, wherein said hydrocarbon oil and said particulate coal are premixed in a weight ratio of from about 1.5:1 to about 10:1.

3. The process of claim 1, wherein the blend is fed over the catalyst particles at a space velocity of from about 40 to about 100 pounds of coal plus oil per hour per cubic foot of reactor.

4. The Process of claim 3, wherein said hydrocarbon oil and said particulate coal are premixed in a weight ratio of from about 1.7:1 to about 3:1.

5. The process of claim 1, wherein the hydrocarbon oil includes recycle oil.

6. The process of claim 5, wherein the recycle oil is residuum-containing oil.

7. The process of claim 5, wherein the total oil to coal ratio is from about 1.5 lbs. of oil per pound of coal to about 10 lbs. of oil per pound of coal.

8. The process of claim 5, wherein the total oil to coal ratio is from about 1.7 lbs. of total oil per pound of coal to about 3 lbs. of total oil per pound of coal.

* * * * *